United States Patent [19]

Pacheco

[11] 4,123,179

[45] Oct. 31, 1978

[54] ORTHOPEDIC FINGER PIECE FOR WRITING INSTRUMENTS

[76] Inventor: Nelly M. Pacheco, 102 Woodland Ct., Carpentersville, Ill. 60110

[21] Appl. No.: 756,824

[22] Filed: Jan. 5, 1977

[51] Int. Cl.[2] ..... A46B 5/02

[52] U.S. Cl. ..... 401/6

[58] Field of Search ..... 401/6, 88, 89

[56] References Cited

U.S. PATENT DOCUMENTS

| | | | |
|---|---|---|---|
| 413,366 | 10/1889 | Haislip | 401/6 |
| 4,030,841 | 6/1977 | Balasty | 401/6 |

FOREIGN PATENT DOCUMENTS

| | | | |
|---|---|---|---|
| 546,632 | 11/1930 | Fed. Rep. of Germany | 401/6 |
| 109,325 | 5/1924 | Switzerland | 401/6 |

*Primary Examiner*—Stephen C. Pellegrino

[57] ABSTRACT

An orthopedic finger piece for writing instruments is disclosed comprising a semi-flexible sleeve which is securable to an elongated writing instrument by means of a gripping member mounted in a second sleeve concentric with the semiflexible sleeve. The gripping member comprises a lever axially mounted in the second sleeve, one end of the lever having a cam lobe thereon that engages a writing instrument when the lever is substantially parallel to the longitudinal axis of the sleeve and disengages a writing instrument when the lever is substantially transverse to the longitudinal axis of the sleeve. When the cam lever is in the aformementioned parallel position the lever's outer edge is substantially flush with the outer wall of the second sleeve and the semi-resilient sleeve.

3 Claims, 4 Drawing Figures

ORTHOPEDIC FINGER PIECE FOR WRITING INSTRUMENTS

SUMMARY OF THE INVENTION

The present invention relates to an orthopedic finger piece for writing instruments and comprises apparatus adapted to fit over an elongated writing instrument to protect fingers and aid in holding such a writing instrument. The apparatus is made up of a semi-resilient sleeve having a bore extending along the longitudinal axis thereof, the bore having a diameter of substantially the same configuration as the diameter of a writing instrument on which the sleeve is mounted through the bore. The diameter of the bore is sufficiently wide to allow the sleeve to be mounted longitudinally along the length of such elongated writing instrument. The sleeve has a writing instrument securing member thereon for holding the sleeve in one position along the length of such a writing instrument. The securing member is engageable and disengageable with such a writing instrument positioned in the sleeve.

The securing member may comprise a lever pivotally mounted on a pivot axle, the pivot axle being secured to the sleeve substantially transverse to the longitudinal axis of the sleeve. The lever has a cam lobe at the end thereof extending through an opening in the sleeve, the cam lobe being arranged to grippingly engage the surface of a writing instrument when the sleeve is positioned thereon and when the lever is substantially parallel to the longitudinal axis of the sleeve. The cam lobe is arranged to substantially disengage the surface of such a writing instrument when the lever is pivoted about the pivot axle to a position substantially normal to the longitudinal axis of the sleeve.

The pivot axle may be mounted in a second sleeve, the bore of the second sleeve being concentric with and having substantially the same diameter as the bore of the semi-resilient sleeve.

The semi-resilient sleeve may partially envelop the second sleeve, the pivot axle being mounted in the second sleeve and a portion of the outer wall of the second sleeve being flush with the portion of the outer wall of the semi-resilient sleeve. The lever is positioned in a recess in the portion of the outer wall of the second sleeve, the outer edge of the lever being flush with the outer edge of the portion of the outer wall of the second sleeve that extends through the semi-resilient sleeve.

DETAILED DESCRIPTION

Figure 1:
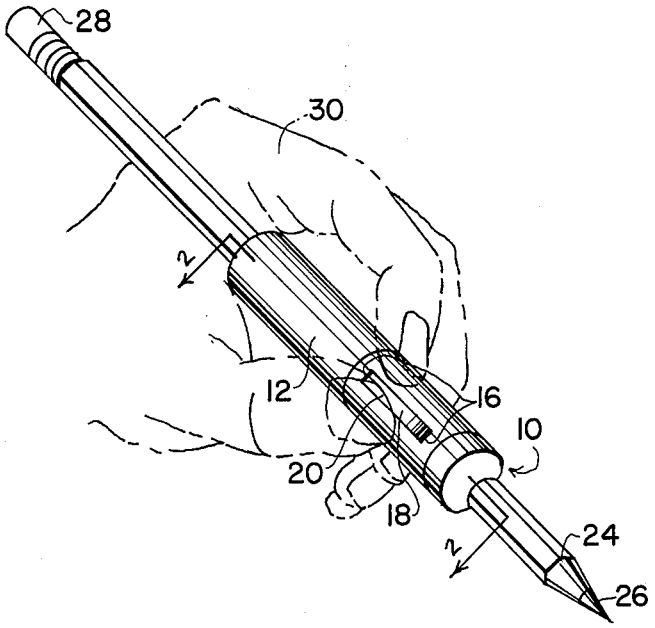
FIG. 1 comprises a perspective view illustrating an orthopedic writing pad for writing instruments comprising a semi-resilient sleeve positioned about an elongated writing instrument such as a pencil, the semi-resilient sleeve having a writing instrument gripping member therein that fits flushly with the outer surface of such sleeve according to one embodiment of the present invention.

Writing instrument finger supports are disclosed in the prior art U.S. Pat. No. Colfelt 1,868,441; LaFrance 1,807,415; Mauthe 1,793,945; Peterson 1,598,873; Harrigan 1,419,257; Graff 1,122,909 and Halsey 291,723.

It is an object of the present invention to provide an orthopedic finger piece for a writing instrument and in the case of a wooden pencil that is sharpened and consequently shortened, the orthopedic finger piece that is provided by the invention is arranged to be moved and secured along the length of the pencil as it is shortened.

It is a further object of the present invention to provide an orthopedic finger piece for a writing instrument to prevent finger callouses, finger bone deformation and to promote finger comfort especially for persons having finger arthritis or other bone problems of the hand.

It is a further object of the present invention to provide an orthopedic finger piece for writing instruments in which the finger piece absorbs finger perspiration to prevent the writing instrument from slipping out of the fingers when used.

These and other objects have been achieved according to the present invention and will become apparent by reference to the disclosure and claims that follow as well as the appended drawing.

Referring to the drawing in FIGS. 1–4 therein, an orthopedic finger piece for a writing instrument 10 is illustrated comprising a semi-resilient sleeve 12 made of a material such as a semi-flexible polyether-urethane rubber or foam rubber, the sleeve 12 in another embodiment also comprising a cork sleeve. The bore 13 of the sleeve 12 is substantially the same diameter as that of pencil 24 and conforms in shape substantially to the configuration of the pencil 24 so that the sleeve 12 may be moved longitudinally along the length of the pencil 24. The pencil 24 has a lead 26 therein and an eraser 28 and comprises a wooden pencil that is sharpened thereby necessitating the movement of the sleeve 12 towards the eraser 28 as the pencil 24 is shortened due to sharpening. A second sleeve 14 is positioned substantially inside of the sleeve 12 and is concentric with sleeve 12, the bore of sleeve 14 being substantially the same as the bore 13 of sleeve 12 so that the sleeve 14 may be moved along the length of pencil 24 with sleeve 12. Sleeve 12 has an opening 16 therein through which one portion of the sleeve 14 projects and is substantially flush with the outer wall of the sleeve 12. A lever 20 is mounted in the portion of the sleeve 14 that projects through opening 16, lever 20 having an axle 22 therein on which the lever 20 pivots. The lever 20 is mounted in an opening 18 in the second sleeve 14 so that the outer face of lever 20 is also substantially flush with the outer surface of the sleeve 12 when lever 23 is arranged to lie substantially parallel to the longitudinal axis of the sleeve 12.

A cam lobe 23 is positioned on the edge of lever 20 and is arranged to grippingly engage the pencil 24 when the lever 20 is pivoted on axle 22 and so that lever 20 lies substantially parallel to the longitudinal axis of sleeve 12. When the lever 20 is pivoted so that it is substantially transverse to the longitudinal axis of sleeve 12 as illustrated in the phantom configuration of lever 20 in FIG. 2, the cam lobe 23 disengages the pencil 24.

Figure 3:
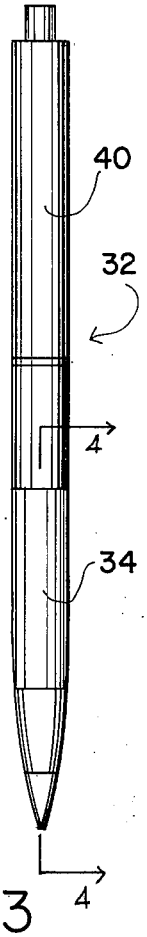
FIG. 3 comprises a side elevation of an orthopedic writing pad positioned on a pen, the writing pad comprising a semi-resilient sleeve positioned around the nib end of the pen, according to another embodiment of the present invention.
Figure 4:
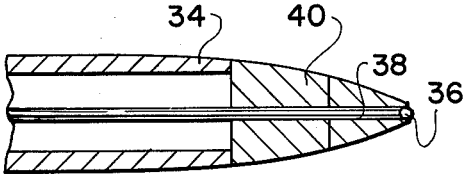
FIG. 4 comprises a side elevation in section taken along the line 4—4 of FIG. 3.

In another embodiment and referring to FIGS. 3 and 4, the orthopedic finger piece is mounted on a pen 40 and comprises a semi-resilient material arranged as a sleeve 34 that fits over the shaft of a pen 40 near the nib end. The pen 40 comprises a ball point pen and has a tubular ink feeding member 38 running the length thereof for carrying ink to a ball point 36 at the nib end of pen 40.

Figure 2:
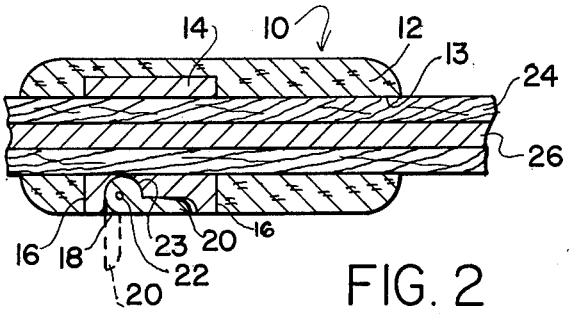
FIG. 2 comprises a side elevation in section taken along the line 2—2 of FIG. 1 and illustrates in greater detail the writing instrument gripping member which comprises a lever having a cam lobe thereon which is pivotally mounted to engage the side wall of a writing instrument when the lever is positioned to be substantially parallel to the longitudinal axis of the semi-resilient sleeve according to another embodiment of the present invention.

In use, the orthopedic finger piece 10 is positioned on a pencil 24 by raising the lever 20 so that it is substantially transverse to the longitudinal axis of the sleeve 12, this raised position of lever 20 being illustrated in phantom configuration in FIG. 2 after which the pencil 24 is inserted through the bore 13 of the sleeve 12 and when the sleeve 12 is positioned sufficiently close to the exposed lead 26 of pencil 24, the lever 20 is depressed in a position so that it lies substantially parallel to the longitudinal axis of sleeve 12 and is also flush with the outer wall of sleeve 12. As the pencil 24 is sharpened and thereby shortened, the sleeve 12 may be moved towards the eraser 28 to compensate for the shortening by raising the lever 20 into the position as shown in phantom configuration in FIG. 2, moving the sleeve 12 towards the eraser 28 and then re-engaging the cam lobe 23 into the side of pencil 24 by depressing the lever 20 so that it is substantially flush with the outer wall of sleeve 12.

The positioning of the sleeve 34 about the pen 40 is fixed in place and need not be moved during the use of the pen 40, since the pen is not shortened as is the pencil 24 during use.

Although the invention has been described by reference to some embodiments, it is not intended that the novel orthopedic finger piece for writing instruments be limited thereby, but that modifications thereof are intended to be included as falling within the broad spirit and scope of the foregoing disclosure, the following claims and the appended drawing.

What is claimed is:

1. Apparatus adapted to fit over an elongated writing instrument to protect fingers and aid in holding such writing instrument comprising a semi-resilient sleeve having a bore extending along the longitudinal axis thereof, said bore having a diameter substantially of the same configuration as the diameter of a writing instrument on which said sleeve is mounted through said bore, the diameter of said bore being sufficiently wide to allow said sleeve to be moved longitudinally along the length of such an elongated writing instrument, said sleeve having writing instrument securing means thereon for holding said sleeve in one position along the length of such a writing instrument, said securing means being engageable and disengageable with such a writing instrument positioned in said sleeve, said securing means comprising a lever pivotally mounted on a pivot axle, said pivot axle being secured to said sleeve substantially transverse to the longitudinal axis of said sleeve, said lever having a cam lobe at the end thereof extending through an opening in said sleeve, said cam lobe being arranged to grippingly engage the surface of a writing instrument when said sleeve is positioned thereon and when said lever is substantially parallel to the longitudinal axis of said sleeves, said cam lobe being arranged to substantially disengage the surface of such a writing instrument when said lever is pivoted about said pivot axle to a position substantially normal to the longitudinal axis of said sleeve.

2. The apparatus of claim 1 wherein said pivot axle is mounted in a second sleeve, the bore of said second sleeve being concentric with and having substantially the same diameter as the bore of said semi-resilient sleeve.

3. The apparatus of claim 2 where said semi-resilient sleeve partially envelopes said second sleeve, said pivot axle being mounted in said second sleeve, a portion of the outer wall of said second sleeve being flush with a portion of the outer wall of said semi-resilient sleeve, said lever being positioned in a recess in said portion of said outer wall of said second sleeve, the outer edge of said lever being flush with the outer edge of said portion of the outer wall of said second sleeve that extends through the second sleeve.

* * * * *